US005284453A

United States Patent [19]

Kun

[11] Patent Number: 5,284,453

[45] Date of Patent: Feb. 8, 1994

[54] RESCUE PACKAGE COMPOSED OF A LIFE RAFT CONNECTED TO A CANISTER OF MATERIALS TO INFLATE THE RAFT

[76] Inventor: Steve I. Kun, 3385 S. U.S. Highway 17-92, #2370, Casselberry, Fla. 32707

[21] Appl. No.: 831,556

[22] Filed: Feb. 5, 1992

[51] Int. Cl.[5] ..... B63H 11/113

[52] U.S. Cl. ..... 441/42; 441/40

[58] Field of Search ..... 441/40, 41, 42, 88, 441/80, 129, 130, 131, 90-92, 35; 114/345

[56] References Cited

U.S. PATENT DOCUMENTS

| | | | |
|---|---|---|---|
| 60,640 | 12/1866 | Murtaugh | 441/43 |
| 1,570,470 | 1/1926 | Fritsche et al. | 441/41 |
| 1,981,871 | 11/1934 | Manson | 114/345 |
| 3,142,850 | 8/1964 | De Boer | 441/41 |
| 4,457,730 | 7/1984 | Foster et al. | 441/42 |
| 4,595,374 | 6/1986 | Wass | 441/41 |

*Primary Examiner*—Ed Swinehart

*Attorney, Agent, or Firm*—Malloy & Malloy

[57] ABSTRACT

A normally deflated and folded life raft in combination with a canister of pressurized materials connected to the life raft in fluid flow relation so that the contents may be released to inflate the life raft at an emergency scene at which a normally closed inflation inlet structure on the raft is opened and a normally closed valve of the canister is opened by an exteriorly accessible operator. As seen from above, the life raft is oval in shape to support a person in a prone attitude; and a net is provided spanning the oval-shaped life raft to support the person. Exterior handles at the forward and aft portions of the life raft are provided for towing the life raft.

1 Claim, 2 Drawing Sheets

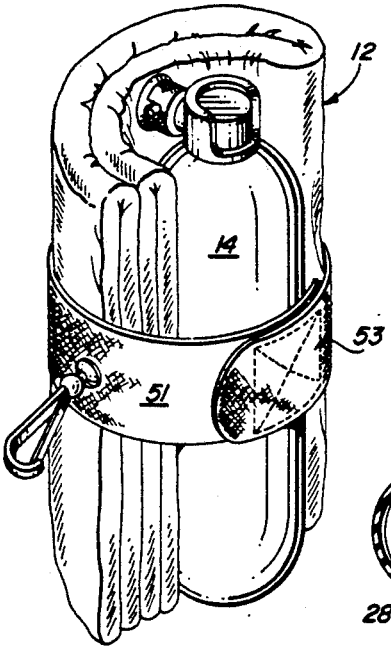
FIG. 1
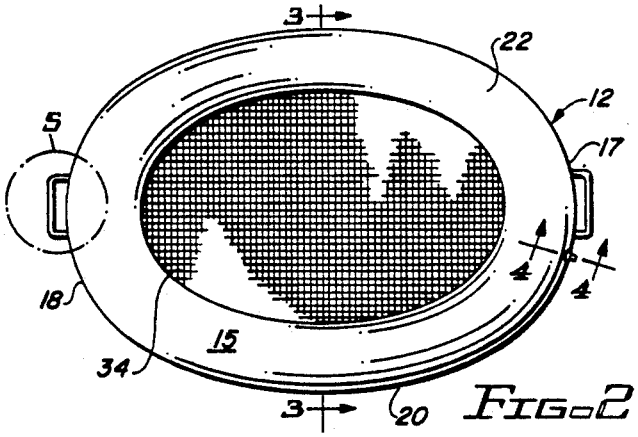
FIG. 2
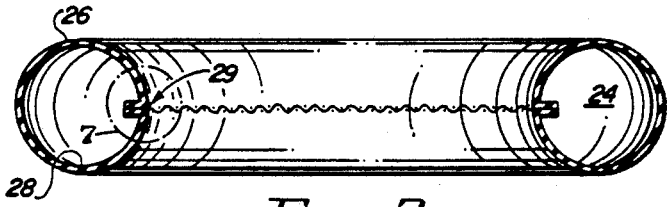
FIG. 3
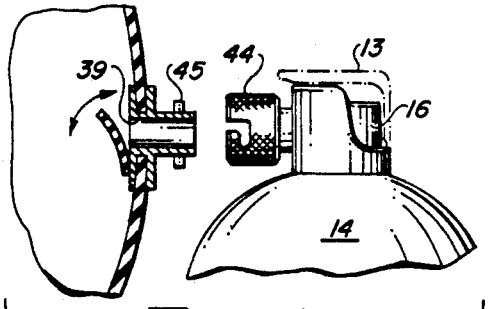
FIG. 4
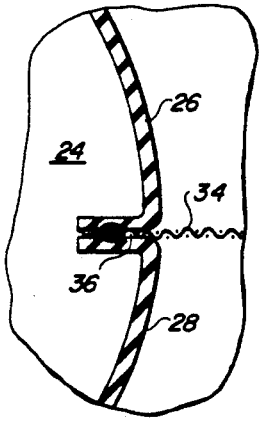
FIG. 7
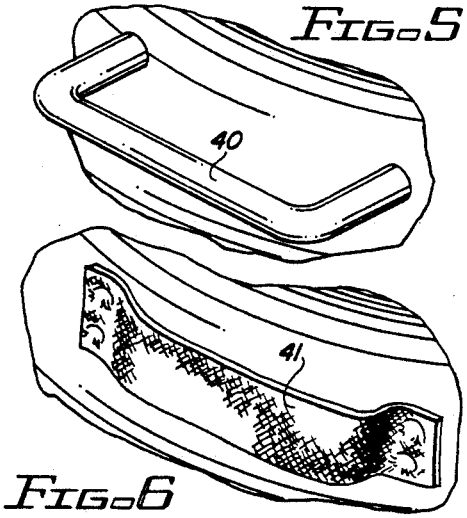
FIG. 5
FIG. 6
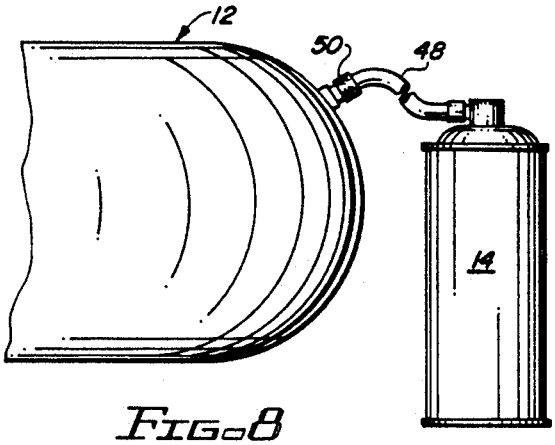
FIG. 8

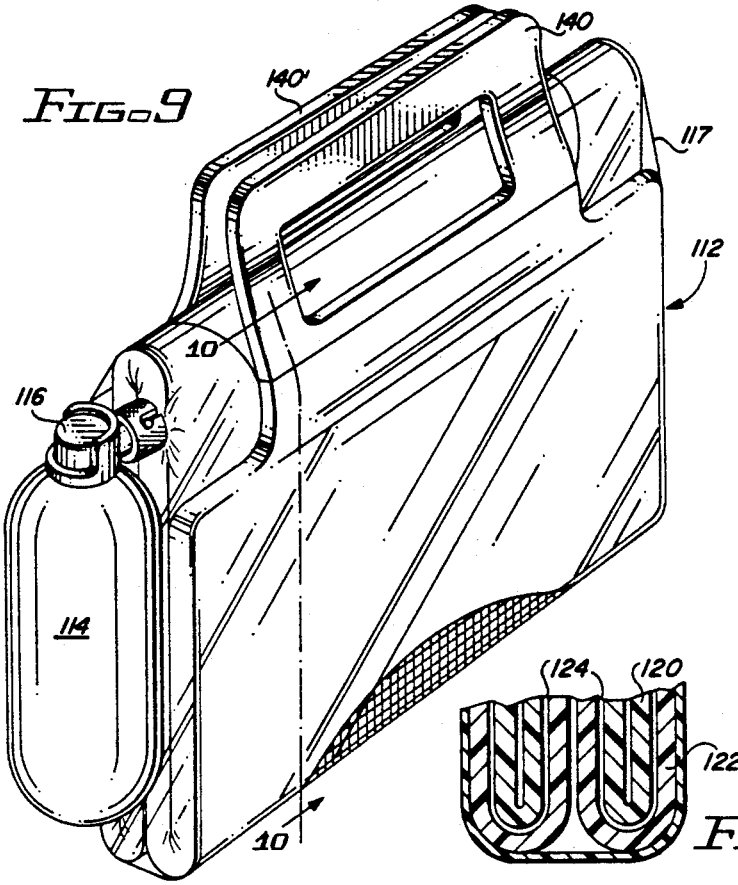
FIG. 9
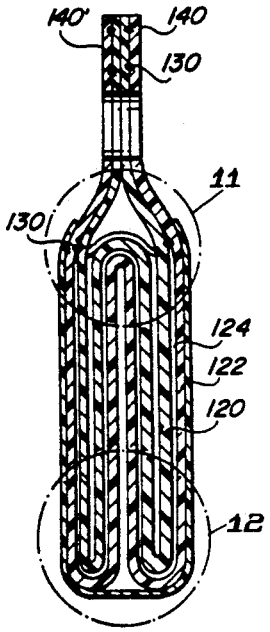
FIG. 10
FIG. 12
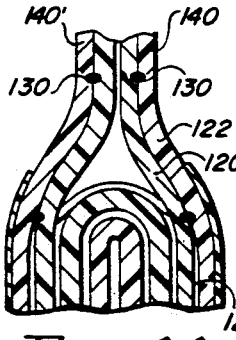
FIG. 11
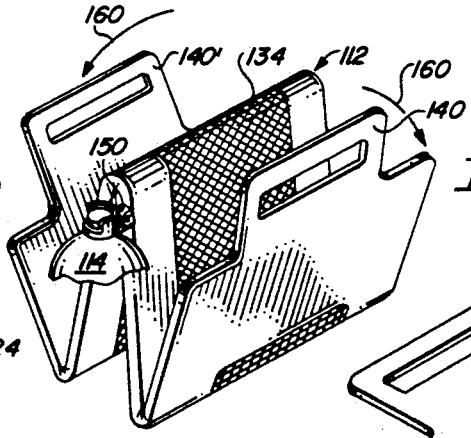
FIG. 13
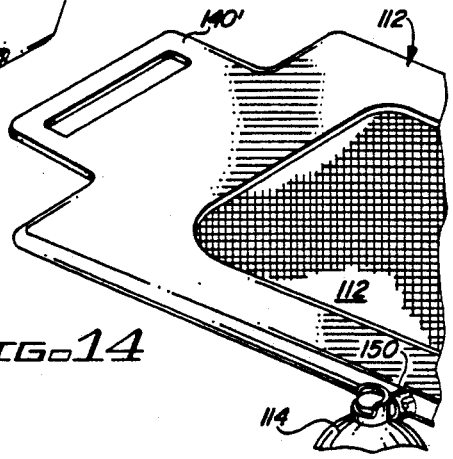
FIG. 14

RESCUE PACKAGE COMPOSED OF A LIFE RAFT CONNECTED TO A CANISTER OF MATERIALS TO INFLATE THE RAFT

FIELD OF THE INVENTION

This invention relates to a normally deflated folded life raft in combination with a canister of pressurized contents interconnected to the life raft comprising a compact package to be carried to an emergency scene where the pressurized contents may be released to rapidly inflate the life raft.

SUMMARY OF THE INVENTION

In the past, there have been numerous types of life rafts for use in supporting and moving a victim and for providing buoyancy to a drowning victim. This invention is of a package composed of a normally folded and deflated life raft connected to a canister of pressurized contents which can be carried to an emergency scene at which the life raft may be rapidly inflated upon release of the pressurized contents. In such emergency situations, time is of the essence; and this invention provides a foldable life raft which can be inflated at an emergency scene to support a victim, for example, a drowning victim in water, simply by releasing the pressurized canister contents, which are sufficient volume to inflate the life raft.

The life raft is composed of a) a generally oval-shaped portion composed of an upper section and a lower section seamed together with a support mesh netting which spans the oval-shaped portion, the life raft being buoyant when inflated, and b) a pressurized canister of material to inflate the life raft, which contains material to inflate the life raft, the canister being normally connected to the life raft when not in use, so that the life raft in a deflated and folded condition may be carried together with the canister as a package to an emergency scene; and there the life raft may be inflated rapidly by release of the contents of the pressurized canister. The combination is lightweight, compact, and provides for a one-step operation; and the life raft is designed to support a victim in a prone position whether conscious or not. It is adaptable to all sizes and weights of commonly encountered individuals; and is provided with handles so that it is easy to tow by a swimmer or behind a small craft such as a rowboat or other type crafts, such as jet skis. It will be appreciated that a person in a prone position supported on a life raft may be provided emergency treatment at the scene of a rescue.

OBJECTS OF THE INVENTION

It is a general object of this invention to provide a package composed of a normally collapsed, deflated, folded life raft connected to a container of pressurized contents which package is adapted to be carried to an emergency scene or the life raft may be rapidly inflated by releasing the pressurized contents.

It is an object of this invention to provide a portable and compact package comprising an inflatable, normally folded life raft and a pressurized container with contents in sufficient volume to inflate the life raft upon release of said contents. The package is especially adapted to be used in areas surrounding water such as lakes, beaches, rivers, and at boat slips. It is especially adapted for use by fire and rescue personnel such as lifeguards, police, and fireman. Also, it may be utilized by personnel at the scene of an aircraft crash, especially one at which access is difficult and especially a crash scene at sea, where it provides a rapidly inflatable life raft. In a preferred embodiment, a canister of pressurized contents are normally interconnected in a portable package so that all that is necessary upon arrival at an emergency scene is to release the pressurized contents to inflate the life raft rapidly. An operator at an emergency scene merely opens a normally closed valve means captivating the pressurized contents in the canister.

BRIEF DESCRIPTION OF THE DRAWINGS

Reference should be had to the following detailed description taken in connection with the accompanying drawings in which:

FIG. 1 is a perspective view of the package.

FIG. 2 is a perspective view of the life raft.

FIG. 3 is a view in cross-section taken on the plane 3—3.

FIG. 4 is a partial view of the zone indicated by the arrowed lines 4—4 and the top of the canister seen in FIG. 1.

FIG. 5 is a partial enlarged view of the handle indicated by the numeral 5 in FIG. 2.

FIG. 6 is an alternative type handle to that shown in FIG. 5.

FIG. 7 is an enlarged and partial view of the zone 7 of FIG. 3.

FIG. 8 is a partial view illustrating the operation of the emergency package.

FIG. 9 is a perspective view of another preferred embodiment of the rescue package.

FIG. 10 is a view in cross-section taken along the plane 10—10.

FIG. 11 is a partial enlarged view of a portion of the life raft of the present invention indicated by the numeral 11 in FIG. 10.

FIG. 12 is a partial enlarged view of the zone 12 in FIG. 10.

FIG. 13 is a perspective view of the life raft illustrating unfolding thereof during the inflation process.

FIG. 14 is a partial view illustrating a handle of the life raft integrally formed therewith.

DESCRIPTION OF THE PREFERRED EMBODIMENT

Referring to the drawings wherein like reference characters designate like or corresponding parts throughout the several views, there is shown a normally deflated and folded life raft generally indicated by the numeral 12 and a canister 14 of pressurized contents comprising in combination a portable, easily carried package. The canister is normally connected to the life raft in fluid communication, so that the pressurized canister contents may be released to inflate the life raft at an emergency scene.

Preferably, there is an exteriorly accessible operator 16 for a valve means on the package and preferably on the canister which upon manipulation will release the pressurized contents and inflate the life raft quickly. In the preferred embodiment, the life raft includes a generally oval-shaped body as seen from above, when it is unfolded and inflated. It has a front portion 17, a rear portion 18, and spaced longitudinally extending side portions 20 and 22. These portions define a continuous inner cavity 24 extending around the oval-shaped body 15. Each portion has an inwardly facing surface and an exterior surface and each portion includes an upper generally semi-circular section 26, see FIG. 3, and a lower generally semi-circular section 28 as well as seam means 29 interconnecting the sections together along the inwardly facing surface. A net means 34 having a peripheral zone 36 is provided in spanning relation of the life raft. It is sized preferably to support a person in a prone attitude. The peripheral zone 36 is secured by the upper and lower sections at the seam means. Further, the raft is provided with a forward, loop-type, rigid handle and a rearward, loop-type, rigid handle 40, see FIG. 5. Preferably, these handles are sized to be gripped by a person for towing the life raft. Each of the handles are centrally located on the front portion and the rear portion respectively and each extends exteriorly away from the raft. Alternatively, the handle may be of fabric material, such as nylon and welded, glued or otherwise secured to the raft, see 41 in FIG. 6.

The raft includes normally closed inlet port means 39 to receive a charge of gas to inflate the raft. The inlet port means may be of the type found on conventional pneumatic tires, that is, a stem including a valve means which is normally biased into a closed position and which is exteriorly threaded for threadable connection to an air supply or, as shown in FIG. 4, a normally closed flap. The pressurized container 14 has an interior chamber with a charge of sufficient volume when released to inflate the continuous inner cavity of the raft. The canister may be of the type conventionally utilized to inflate a tire on a vehicle which has been punctured; and in any event, includes an outlet port means 44, a normally closed valve means, and an exterior operator means 16 to open the valve means. In a preferred embodiment, see FIG. 8, the outlet port means may 44 will include a hose length 48 having a threaded distal end 50 interiorly threaded and sized for mating threaded connection with the inlet port means of the life raft. The port means, it is seen are mutually intercooperable to mate with one another, whether as shown in FIG. 4 or FIG. 5, and define a fluid passageway through the port means to permit gas flow from the canister into the inner cavity of the raft to inflate the oval-shaped body when the valve means is opened by the exterior operator mean 16.

In a preferred embodiment, the peripheral zone of the net means is captivated in the seam means interconnecting the sections along the inwardly facing surfaces of the portions and preferably the entire peripheral zone is in the continuous inner cavity 24, that is, the net is secured all the way around its periphery.

In use, the package composed of the folded life raft and connected pressurized canister is carried to an emergency scene, such as at a lake, in which a victim is drowning, whereupon the exteriorly accessible operator means is utilized to open the valve means of the pressurized container to quickly inflate the life raft. The pressurized canister may then separated from the life raft and the life raft may be towed by the handles. FIG. 4 illustrates a quick, twist off, bayonet connection 45, one-half turn, of the port means. An optimal protective cap 13 which snaps off easily may be provided for the operator to avoid accidental discharge of the material in the canister.

In a preferred embodiment, the valve means of the canister may be trigger actuated. In any event, the intention is that the valve means are of the type which can be quickly opened and remain open until the contents of the canister have been discharged filling and inflating the life raft as quickly as possible.

A keeper means in the form of a strap 51 with a Velcro or hook and loop closure patch means 53. The strap 51 may optimally be provided with a hook to attach to a life vest or lifeguard belt.

With reference to FIGS. 9–14, an initially FIG. 9, another preferred embodiment of the rescue package is illustrated and including a normally deflated folded life raft generally indicated by the numeral 113 and a canister 114 having pressurized contents therein. As seen in FIG. 9, the canister 114 is normally connected to the deflated folded life raft 112 in fluid communication therewith, so that the pressurized contents of the canister 114 are adapted to be readily released to an interior of the lift raft for inflation at the emergency scene.

The canister 114 includes an exteriorly accessible operator 116 for operating a valve means on the canister which upon manipulation will release the pressurized contents and will inflate the life raft. The canister 114 is attached along side the life raft and the folded life raft 112 as to facilitate easy disconnection therefrom for inspection of the pressurized canister 114 or replacement of a newly charged canister.

In the second preferred embodiment illustrated in FIG. 9, the life raft 112 is preferably wrapped in a plastic film 117 to maintain the life raft 112 in the folded position such that integrally formed handles 140, 140′ are disposed in a readily accessible position for carrying the entire package. Upon operation of the operator button 116 and subsequent release of the pressurized contents of the canister 114 to inflate the lift raft 112, the plastic film 117 will readily tear and break away allowing the life raft 112 to unfold into an operable position at the emergency scene.

The life raft preferably includes an upper wall 120 and a lower wall 122 which are generally disposed in surrounding relation to an inner cavity 124 adapted to receive the pressurized contents of the canister 114 during inflation of the life raft. The upper and lower walls 120, 122, are preferably sealed at opposite ends of the life raft by seal means 130. The seal means 130 may be done by such means as heat sealing, sonic weld seal, or through use of various chemical or adhesive substances.

As best seen in FIG. 11, the upper wall 120 and lower wall 122 are adjoined together at opposite ends of the raft by the seal means 130 to form the handles 140, 140′. In the folded, deflated position, the handles 140, 140′ are preferably disposed in adjacent relation to one another so that the package can be easily carried.

The canister 114 is connected by a coupling 150 to valve means on a side of the raft 112. Upon inflation of the life raft, the handles 140 and 140′ at opposite ends of the raft move outwardly in opposite directions as indicated by the arrows 160 as the raft 112 unfolds.

As seen in FIGS. 13 and 14, a central portion of the raft includes net means 134 which is integrally attached along a peripheral edge to the upper and lower walls 120, 122 of the life raft 112. The net means 134 is specifically structured and disposed to support a person in a prone attitude on the life raft during rescue operations, while permitting water from waves and the like to pass therethrough, thus preventing the central portion of the raft from filling with water.

While this invention has been shown and described in what is considered to be a practical and preferred embodiment, it is recognized that departures may be made within the spirit and scope of this invention which should, therefore, not be limited except as set forth in the following claims and within the doctrine of equivalents.

What is claimed is:

1. A portable rescue package comprising, in combination, a folded, normally deflated, life raft, a canister of pressurized contents normally connected to said life raft in fluid flow relation, and valve means on said canister to release the pressurized contents in said canister to inflate said life raft after being carried to an emergency scene, said folded, normally deflated life raft including an inflatable, generally oval-shaped body as seen in plan when unfolded and inflated, said oval-shaped body including an upper generally semi-annular section and a lower generally semi-annular section, said semi-annular sections being integrally formed with one another along an outwardly facing surface and being interconnected to one another by seam means disposed along an inwardly facing surface, thereby defining a continuous inner cavity between said semi-annular sections, said life raft including a net means having a peripheral zone, said net means spanning said life raft when inflated and being sized to support a person in a prone attitude, said peripheral zone being captured in said seam means between said upper generally semi-annular section and said lower generally semi-annular section, said life raft further including a forward rigid handle means and a rearward rigid handle means, said handle means being structured and disposed to be gripped by a hand of a user for towing said life raft, a first normally closed port means disposed in said life raft, said first normally closed port means being structured and disposed to receive a charge of gas from said canister therethrough into said continuous inner cavity so as to inflate said life raft, said canister having an interior chamber with a charge of sufficient volume when released to gaseously inflate said continuous inner cavity, said canister further including a second port means and an exterior operator means to open said valve means on said canister, said first and said second port means being mutually intercooperable to mate with one another and define a fluid passageway through said first and said second port means to permit gas flow therethrough from said canister into said inner continuous cavity so as to inflate said oval-shaped body when said valve means is opened by said exterior operator means, said second port means including hose means, said hose means having a threaded distal end structured and disposed for threaded interconnection with a threaded distal end of said first port means, said folded, normally deflated life raft being substantially encapsulated within a shrink wrap plastic film, said film being specifically structured and disposed to maintain said life raft in a folded position and to break away from said life raft during inflation thereof thereby facilitating unfolding of said life raft, said handles being disposed at corresponding opposite distal ends of said life raft such that said handles are disposed in adjacent relation to one another on said folded, normally deflated life raft, when in said folded position, thereby facilitating carrying of the package, and said canister being releasably connected to said life raft so as to be positioned and disposed along a side thereof and facilitate disconnection from said life raft for inspection or replacement thereof.

* * * * *